US007071144B2

(12) United States Patent
Hizatate

(10) Patent No.: US 7,071,144 B2
(45) Date of Patent: Jul. 4, 2006

(54) THERMAL RECORDING MATERIAL

(75) Inventor: Shoji Hizatate, Tokyo (JP)

(73) Assignee: Mitsubishi Paper Mills, Ltd., Tokyo (JP)

( * ) Notice: Subject to any disclaimer, the term of this patent is extended or adjusted under 35 U.S.C. 154(b) by 0 days.

(21) Appl. No.: 10/490,434

(22) PCT Filed: Sep. 28, 2001

(86) PCT No.: PCT/JP01/08592

§ 371 (c)(1),
(2), (4) Date: Apr. 12, 2004

(87) PCT Pub. No.: WO03/031195

PCT Pub. Date: Apr. 17, 2003

(65) Prior Publication Data

US 2005/0030366 A1 Feb. 10, 2005

(30) Foreign Application Priority Data

Aug. 9, 2000 (JP) ..... 2000-240518

(51) Int. Cl.
*B41M 5/30* (2006.01)

(52) U.S. Cl. ..... 503/209; 503/216; 503/217; 503/221

(58) Field of Classification Search ..... 503/208, 503/209, 216, 217, 221
See application file for complete search history.

(56) References Cited

U.S. PATENT DOCUMENTS 5,212,145 A * 5/1993 Tsuchida et al. ..... 503/207
5,272,127 A * 12/1993 Mandoh et al. ..... 503/207
5,876,898 A * 3/1999 Ikeda et al. ..... 430/203
6,017,848 A * 1/2000 Mando et al. ..... 503/226

FOREIGN PATENT DOCUMENTS

| | | |
|---|---|---|
| EP | 1092552 | 4/2001 |
| JP | 48-19231 | 3/1973 |
| JP | 57-064593 | 4/1982 |
| JP | 57-212096 | 12/1982 |
| JP | 60-056588 | 4/1985 |
| JP | 60-219086 | 11/1985 |
| JP | 61-249789 | 11/1986 |
| JP | 62-055189 | 3/1987 |
| JP | 6-312580 | 11/1994 |
| JP | 2000-247035 | 9/2000 |
| JP | 2001-80216 | 3/2001 |
| JP | 2001-80218 | 3/2001 |
| JP | 2001-113832 | 4/2001 |
| JP | 2001-205941 | 7/2001 |
| JP | 2001-232947 | 8/2001 |
| JP | 2001-239761 | 9/2001 |

* cited by examiner

*Primary Examiner*—B. Hamilton Hess
(74) *Attorney, Agent, or Firm*—Wenderoth, Lind & Ponack, L.L.P.

(57) ABSTRACT

Provided is a thermal recording material that is excellent in thermal response and retainability of an image portion and which generates fewer residues adhering to the thermal head of a thermal printer.

The thermal recording material having a thermal recording layer comprising a generally colorless or light-colored electron-donating dye precursor and an electron-accepting developer that reacts under heat to cause said dye precursor to form a color, said thermal recording layer containing a specific diphenylsulfone derivative, a specific amide derivative and a specific fluorane derivative, wherein the weight ratio of the specific diphenylsulfone derivative above and the specific amide derivative above is 2/1 to 1/2.

6 Claims, No Drawings

THERMAL RECORDING MATERIAL

This application is a U.S. national stage of International Application No. PCT/JP01/08592 filed Sep. 28, 2001.

TECHNICAL FIELD

The present invention relates to a thermal recording material, particularly to a thermal recording material that is excellent in thermal response and image retainability and which generates fewer residues adhering to the thermal head of a thermal printer so that it is free of a printing problem in long-distance printing.

TECHNICAL BACKGROUND

Generally, a thermal recording material has a substrate and a heat-sensitive recording layer formed thereon, the heat-sensitive recording layer containing, as main components, a generally colorless or light-colored electron-donating dye precursor and an electron-accepting developer that reacts under heat to cause the dye precursor to develop a color. When the thermal recording material is heated with a thermal head, a hot pen or a laser beam, the dye precursor and the electron-accepting developer readily react with each other to give a recording image. Such thermal recording materials give recordings with a relatively simple apparatus and have advantages that their maintenance is easy and that they cause no noise. They are used in broad fields of measuring recorders, facsimile machines, printers, computer terminals, labels, automatic vending machines of railway tickets, and the like.

In recent years, particularly, thermal recording materials are used as accounting-related recording sheets such as gas, water and electricity bills, ATM slips of banking facilities and various receipts.

While the use and demands of thermal recording materials have been broadened in various ways, decreasing of residues adhering to a thermal head is required in addition to high thermal response and high color density that are basic properties.

That is, in the above thermal recording material for use as an accounting-related recording sheet, an unclear printing caused by residues adhering to a thermal head or the like during a long-distance printing cannot be permitted. This is true to a higher degree with regard to a portable printer using a sheet for the above bills, since it is difficult to have the portable printer checked for maintenance, for example, to have a thermal head cleaned, when a meter checker is outside.

Since it is difficult to attain an improvement in the above property on the basis of a thermal recording layer alone, JP-A-61-249789, JP-A-62-55189, etc., propose methods in which a protective layer for overcoming the adherence of residues to a thermal head and attaining improvements in other properties is formed on a thermal recording layer.

Under the circumstances, however, no thermal recording materials that cause fewer residues to adhere to a thermal head have been provided even if the above methods are employed, and it is still demanded to improve the above property on the basis of a thermal recording layer alone for decreasing energy and a cost.

For improving thermal response, a sensitizer is added as required. The sensitizer has the activity of promoting a color-forming reaction by dissolving or including a dye precursor and an electron-accepting developer near it when the sensitizer itself is melted by transmitted heat energy. It is therefore one of means of increasing the sensitivity of a thermal recording material to improve the compatibility thereof with the dye precursor and the electron-accepting developer.

As the above means, JP-A-48-19231 discloses embodiments in which waxes are added, JP-A-57-64593 discloses embodiments in which a naphthol derivative is added, and JP-A-60-56588 discloses embodiments in which diphenoxyethanes are added. Since, however, the addition of these sensitizers involves an increase in the amount of a heat-fusible substance, it is very difficult to decrease the amount of residues adhering to a thermal head.

DISCLOSURE OF THE INVENTION

It is an object of the present invention to provide a thermal recording material that has high thermal response and high color density as basic properties of a thermal recording material and which has excellent image retainability and which generates fewer residues adhering to a thermal head of a thermal printer.

The present inventors have made diligent studies and as a result have invented the thermal recording material of the present invention which can overcome the above problem.

That is, the present invention is directed to a thermal recording material having a thermal recording layer comprising a generally colorless or light-colored electron-donating dye precursor and an electron-accepting developer that reacts under heat to cause said dye precursor to form a color, said thermal recording layer containing a diphenylsulfone derivative of the general formula (1),

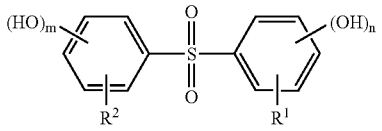

(1)

wherein each of $R^1$ and $R^2$ may be the same as, or different from, other and is a hydrogen atom, a halogen atom, an alkyl group, an alkenyl group, an aralkyl group, an aryl group or an arylsulfonyl group, m is an integer of 1 to 3, and n is an integer of 0 to 2, an amide derivative of the general formula (2),

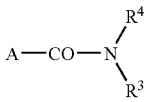

(2)

wherein A is an alkyl group, an alkenyl group or an alkylamino group, each of $R^3$ and $R^4$ may be the same as, or different from, other and is a hydrogen atom, an alkyl group, an alkenyl group, an aralkyl group or an aryl group, and a fluorane derivative of the general formula (3), (3)

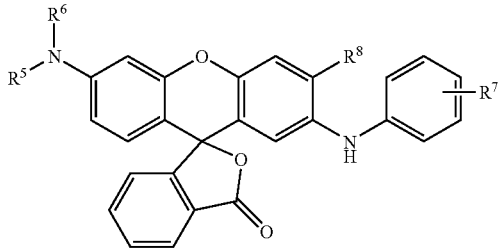

wherein each $R^5$ and $R^6$ may be the same as, or different from, other and is an alkyl group having 1 to 5 carbon atoms, a cyclohexyl group or an aryl group, $R^7$ is a hydrogen atom, methyl, trifluoromethyl or a halogen atom and $R^8$ is a hydrogen atom, methyl or a halogen atom, wherein the weight ratio of the diphenylsulfone derivative of the general formula (1) and the amide derivative of the general formula (2) (compound (1)/compound (2)) is 2/1 to 1/2.

In the thermal recording material of the present invention, the thermal recording layer may contain at least one other sensitizer selected from ethylene glycol di-m-tolyl ether, 2-benzyloxynaphthalene, bis(4-methylbenzyl)oxalate, 1,2-bis(phenoxymethyl)benzene, p-acetotoluidine or 4-(4-methylphenoxy)biphenyl.

Further, in the thermal recording material of the present invention, preferably, the weight ratio (compound (2)/other sensitizer) of the amide derivative of the general formula (2) and the other sensitizer selected from ethylene glycol di-m-tolyl ether, 2-benzyloxynaphthalene, bis(4-methylbenzyl) oxalate, 1,2-bis(phenoxymethyl)benzene, p-acetotoluidine or 4-(4-methylphenoxy)biphenyl in the thermal recording layer is in the range of 1/2 to 5/1.

In the thermal recording material of the present invention, the thermal recording layer may contain a compound of the general formula (4), (4)

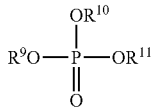

wherein each of $R^9$, $R^{10}$ and $R^{11}$ may be the same as, or different from, others and is a hydrogen atom, an alkyl group, an alkenyl group-, an aryl group, an aralkyl group, an alkali metal, an alkaline earth metal, a transition metal or an amine, and any two substituents of $R^9$, $R^{10}$ and $R^{11}$ may bond to each other and form a ring.

In the thermal recording material of the present invention, further, the thermal recording layer may contain a compound of the general formula (5), (5)

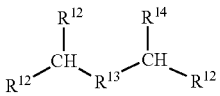

wherein $R^{12}$ is a group of the general formula (6), (6)

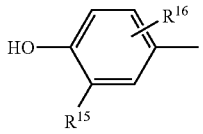

in which $R^{15}$ is cyclohexyl, phenyl or tert-butyl and $R^{16}$ is a hydrogen atom, an alkyl group having 1 to 8 carbon atoms, cyclohexyl, phenyl or tert-butyl, $R^{13}$ is a covalent bond or an alkylene group having 1 to 3 carbon atoms and $R^{14}$ is a hydrogen atom, an alkyl group having 1 to 8 carbon atoms or any group represented by $R^{12}$.

In the thermal recording material of the present invention, the thermal recording layer may contain a compound of the general formula (7),

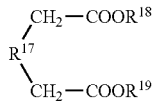

wherein $R^{17}$ is a covalent bond, an alkylene group having 1 to 8 carbon atoms or a group of the general formula (8), (8)

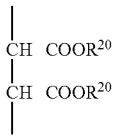

in which $R^{20}$ is 2,2,6,6-tetramethyl-4-piperidyl or 1,2,2,6,6-pentamethyl-4-piperidyl, and each of $R^{18}$ and $R^{19}$ may be the same as, or different from, other and is 2,2,6,6-tetramethyl-4-piperidyl or 1,2,2,6,6-pentamethyl-4-piperidyl.

In the thermal recording material of the present invention, the diphenylsulfone derivative of the general formula (1) is preferably 4,4'-dihydroxydiphenylsulfone.

PREFERRED EMBODIMENTS OF THE INVENTION

The present invention will be further specifically explained.

In the thermal recording material of the present invention, a diphenylsulfone derivative of the general formula (1) is used as an electron-accepting developer that constitutes part of the thermal recording layer and causes a dye precursor to form a color.

(1)

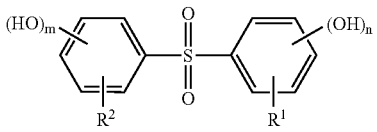

In the general formula (1), each of $R^1$ and $R^2$ may be the same as, or different from, other and is a hydrogen atom, a halogen atom, an alkyl group, an alkenyl group, an aralkyl group, an aryl group or an arylsulfonyl group. The above halogen atom includes chlorine, bromine, iodine and fluorine, and the above alkyl group includes methyl, ethyl, linear or branched propyl, linear or branched butyl and linear or branched pentyl. The above alkenyl group includes vinyl and allyl, and the above aralkyl group includes benzyl and phenethyl. The above aryl group includes phenyl, naphthyl and 4-methylphenyl, and the above arylsulfonyl group includes phenylsulfonyl, 4-methylphenylsulfonyl and 2-methylphenylsulfonyl.

Specific examples of the compound of the above general formula (1) include 4,4'-dihydroxydiphenylsulfone, 2,4'-dihydroxydiphenylsulfone, 4-hydroxydiphenylsulfone, 4-hydroxy-4'-methyldiphenylsulfone, bis(3-allyl-4-hydroxyphenyl)sulfone, bis(3,5-dibromo-4-hydroxyphenyl)sulfone, bis(3,5-dichloro-4-hydroxyphenyl)sulfone, 3,4-hydroxydiphenylsulfone, 3,4-dihydroxy-4'-methyldiphenylsulfone, 3,4,4'-trihydroxydiphenylsulfone, 3,4,3',4'-tetrahydroxydiphenylsulfone, 2,3,4-trihydroxydiphenylsulfone and 4-hydroxy-3-phenylsulfonyldiphenylsulfone, while the compound of the general formula (1) shall not be limited thereto.

These diphenylsulfone derivatives may be used alone or in combination as required.

According to the present invention, the thermal recording layer contains, as essential components, the amide derivative of the general formula (2) and the fluorane derivative of the general formula (3) together with the above diphenylsulfone derivative of the general formula (1), and the weight ratio of the diphenylsulfone derivative of the general formula (1) and the amide derivative of the general formula (2) (compound (1)/compound (2)) is adjusted to 2/1 to 1/2, whereby there can be obtained the thermal recording material that exhibits higher thermal response and further generates fewer residues adhering to the thermal head of a thermal printer and which does not cause printing failures even in long-distance printing.

In the thermal recording material of the present invention, the amide derivative that is contained in the thermal recording layer works as a sensitizer and has a chemical formula represented by the general formula (2).

(2)

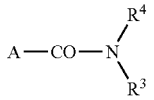

In the above general formula (2), A is an alkyl group, an alkenyl group or an alkylamino group, and the alkyl group includes long-chain alkyl groups having 12 to 22 carbon atoms. The alkenyl group includes long-chain alkenyl groups having 12 to 22 carbon atoms. The alkylamino group includes amino groups in which amino groups are substituted on the above alkyl groups. Further, the alkyl group or the alkylamino groups may have a substituent such as an alkenyl group, an aryl group, an alkoxy group, a halogen atom, a hydroxyl group, an acyl group, an acyloxy group or an acylamino group.

In the general formula (2), each of $R^3$ and $R^4$ may be the same as, or different from, other and is a hydrogen atom, an alkyl group, a hydroxyalkyl group, an alkenyl group, an aralkyl group or an aryl group. The alkyl group includes methyl, ethyl, linear or branched propyl, linear or branched butyl, linear or branched pentyl and long-chain alkyl groups having 12 to 22 carbon atoms. The above hydroxyalkyl group includes groups in which a hydroxyl group is substituted on the above alkyl groups. The above alkenyl group includes vinyl, allyl, oleyl and cis-13-docosenyl. The above aralkyl group includes benzyl and phenethyl. The above aryl group includes phenyl, 4-methylphenyl and naphthyl. Further, the alkyl group or the aryl group may have a substituent such as acyl, acyloxy or acylamino.

Examples of the compound of the general formula (2) includes lauric acid amide, palmitic acid amide, stearic acid amide, behenic acid amide, erucic acid amide, N-palmitylpalmitic acid amide, N-stearylstearic acid amide, N-stearyl-12-hydroxystearic acid amide, N-oleyl-12-hydroxystearic acid amide, N-methylolstearic acid amide, N-methylolbehenic acid amide, methylenebisstearic acid amide, methylenebislauric acid amide, methylenebis(12-hydroxystearic acid amide), ethylenebiscaprylic acid amide, ethylenebislauric acid amide, ethylenebisstearic acid amide, ethylenebisisostearic acid amide, ethylenebis(12-hydroxylstearic acid amide), ethylenebisbehenic acid amide, hexamethylenebisstearic acid amide, hexamethylenebisbehenic acid amide, hexamethylenebis(12-hydroxystearic acid amide), butylenebisstearic acid amide, methylenebisoleic acid amide, ethylenebisoleic acid made, ethylenebiserucic acid amide, hexamethylenebisoleic acid amide, 1,3-xylylenebisstearic acid amide, N-butyl-N'-stearylurea, N-phenyl-N'-stearylurea and N,N'-distearylurea, while the compound of the general formula (2) shall not be limited thereto. These compounds may be used alone or in combination as required.

Of the above amide derivatives of the general formula (2), palmitic acid amide, stearic acid amide, behenic acid amide, N-methylolstearic acid amide and ethylenebisstearic acid amide are preferred, since the thermal recording material is excellent in thermal response.

In the thermal recording material of the present invention, further, a fluorane derivative of the general formula (3) is used as a generally colorless or light-colored electron-donating dye precursor that constitutes part of the thermal recording layer.

(3)

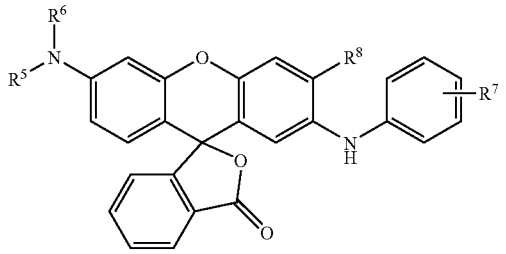

In the general formula (3), each of $R^5$ and $R^6$ may be the same as, or different from, other and is an alkyl group having 1 to 5 carbon atoms, a cyclohexyl group or an aryl group (phenyl group, or the like), $R^7$ is a hydrogen atom, methyl, trifluoromethyl or a halogen atom (chlorine, bromine, iodine or fluorine), and $R^8$ is a hydrogen atom, methyl or a halogen atom (chlorine, bromine, iodine or fluorine).

Examples of the compound of the general formula (3) include 3-dibutylamino-7-(2-chloroanilino)fluorane, 3-diethylamino-7-(2-chloroanilino)fluorane, 3-diethylamino-6-methyl-7-anilinofluorane, 3-dibutylamino-6-methyl-7-anilinofluorane, 3-dipentylamino-6-methyl-7-anilinofluorane, 3-(N-ethyl-N-tolyl)amino-6-methyl-7-anilinofluorane, 3-(N-ethyl-N-tolyl)amino-6-methyl-7-(4-toluidino)fluorane, 3-piperidino-6-methyl-7-anilinofluorane, 3-diethylamino-7-(4-nitroanilino)fluorane, 3-(N-methyl-N-propyl)amino-6-methyl-7-anilinofluorane, 3-(N-ethyl-N-isoamyl)amino-6-methyl-7-anilinofluorane, 3-(N-methyl-N-cyclohexyl)amino-6-methyl-7-anilinofluorane, 3-(N-ethyl-N-tetrahydrofurfuryl)amino-6-methyl-7-anilinofluorane, 3-diethylamino-7-(3-trifluoromethylanilino)fluorane and 3-diethylamino-6-chloro-7-anilinofluorane, while the compound of the general formula (3) shall not be limited thereto. These compounds may be used alone or in combination as required.

Of the above compounds of the general formula (3), particularly preferred are 3-dibutylamino-6-methyl-7-anilinofluorane, 3-diethylamino-6-methyl-7-anilinofluorane, 3-(N-ethyl-N-isoamyl)amino-6-methyl-7-anilinofluorane, 3-(N-methyl-N-cyclohexyl)amino-6-methyl-7-anilinofluorane, 3-dibutylamino-7-(2-chloroanilino)fluorane and 3-dipentylamino-6-methyl-7-anilinofluorane.

In the thermal recording material of the present invention, the weight ratio of the diphenylsulfone derivative of the general formula (1) and the amide derivative of the general formula (2) (compound (1)/compound (2)) is preferably in the range of 2/1 to 1/2.

When the weight ratio of the diphenylsulfone derivative of the general formula (1) exceeds the above range, no good thermal response can be obtained. When it is smaller than the above range, the saturation printing density decreases.

In the thermal recording material of the present invention, the thermal recording layer may optionally contain a compound selected from ethylene glycol di-m-tolyl ether, 2-benzyloxynaphthalene, bis(4-methylbenzyl)oxalate, 1,2-bis(phenoxymethyl)benzene, p-acetotoluidine or 4-(4-methylphenoxy)biphenyl. These compounds may be used alone or in combination. These compounds give a thermal recording material having high thermal response. The reason therefore is presumably that these compounds improve compatibility between the dye precursor and the electron-accepting developer.

In the present invention, the weight ratio of the amide derivative of the general formula (2) and other sensitizer selected from ethylene glycol di-m-tolyl ether, 2-benzyloxynaphthalene, bis(4-methylbenzyl)oxalate, 1,2-bis(phenoxymethyl)benzene, or 4-(4-methylphenoxy)biphenyl (compound (2)/other sensitizer) is preferably in the range of 1:2 to 5:1. When the weight ratio of the amide derivative of the general formula (2) is outside the above range, no good thermal response can be obtained.

In the thermal recording material of the present invention, a phosphoric ester derivative of the general formula (4)

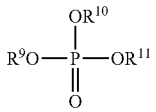

(4)

may be incorporated into the thermal recording layer as required, whereby there can be obtained a thermal recording material that is further improved in retainability of an image portion against temperatures and which is also excellent in thermal response.

In the general formula (4), each of $R^9$, $R^{10}$ and $R^{11}$ may be the same as, or different from, others and is a hydrogen atom, an alkyl group, an alkenyl group, an aryl group, an aralkyl group, an alkali metal, an alkaline earth metal, a transition metal or an amine. The alkyl group includes methyl, ethyl, linear or branched propyl, linear or branched butyl and linear or branched pentyl. The above alkenyl group includes vinyl, allyl and oleyl, the above aryl group includes phenyl, naphthyl, 4-tert-butylphenyl, 4,6-di-tert-butylphenyl, 4-chlorophenyl, 4-benzyloxyphenyl and 3,5-di-tert-butyl-4-hydroxyphenyl, and the above aralkyl group includes benzyl and phenethyl. The above alkali metal includes Li, Na and K. The above alkaline earth metal includes Ba and Ca. The above transition metal includes Zn and Fe. The above amine includes an ammonium group and substituted ammonium groups such as an alkyl-substituted ammonium group.

Examples of the phosphoric ester derivative of the general formula (4) include triphenyl phosphate, diphenyl phosphate, bis(4-tert-butylphenyl) phosphate, bis(4,6-di-tert-butylphenyl) phosphate, bis(4-chlorophenyl) phosphate, bis(benzyloxyphenyl) phosphate, 2,2'-methylenebis(4,6-di-tert-butylphenyl) phosphate, dimethyloxyphosphate, diethyloxyphosphate, bis(3,5-di-tert-butyl-4-hydroxyphenyl) phosphate, 3,5-di-tert-butyldiphenyl phosphate, bis(4-tert-butylphenyl) phosphate, bis(4,6-di-tert-butylphenyl) phosphate, bis(4-chlorophenyl) phosphate, bis(benzyloxyphenyl) phosphate, 2,2'-methylenebis(4,6-di-tert-butylphenyl) phosphate, dimethyloxyphosphate, diethyloxyphosphate, diethyl(3,5-di-tert-butyl-4-hydroxyphenyl) phosphate, a sodium salt of 2,2'-methylenebis(4,6-di-tert-butylphenyl) phosphate, a calcium salt of 2,2'-methylenebis(4,6-di-tert-butylphenyl) phosphate, a zinc salt of 2,2'-methylenebis(4,6-di-tert-butylphenyl) phosphate and an ammonium salt of 2,2'-methylenebis(4,6-di-tert-butylphenyl) phosphate. These may be used alone or in combination.

Of the above phosphoric ester derivatives of the general formula (4), preferred are 2,2'-methylenebis(4,6-di-tert-butylphenyl) phosphate and a sodium salt of 2,2'-methylenebis(4,6-di-tert-butylphenyl) phosphate.

The amount of the phosphoric ester derivative of the general formula (4) that is incorporated based on the electron-accepting developer is preferably 1 to 30% by weight, more preferably 3 to 10% by weight.

When the amount of the phosphoric ester derivative of the general formula (4) based on the electron-accepting developer is less than 1% by weight, there is produced little effect on improvement in image retainability. When it exceeds 30% by weight, the phosphoric ester derivative inhibits a contact between the electron-donating dye precursor and the electron-accepting developer and is liable to cause a decrease in the property of thermal response.

In the thermal recording material of the present invention, the thermal recording layer may contain a hindered phenol derivative of the general formula (5),

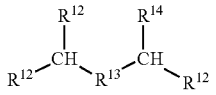

(5)

wherein $R^{12}$ is a group of the general formula (6),

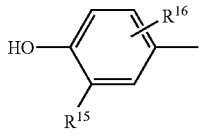

(6)

in which $R^{15}$ is cyclohexyl, phenyl or tert-butyl and $R^{16}$ is a hydrogen atom, an alkyl group having 1 to 8 carbon atoms, cyclohexyl, phenyl or tert-butyl, $R^{13}$ is a covalent bond or an alkylene group having 1 to 3 carbon atoms, and $R^{14}$ is a hydrogen atom, an alkyl group having 1 to 8 carbon atoms or any group represented by $R^{12}$, whereby there can be obtained a thermal recording material that is improved in retainability of an image portion against temperatures.

In the general formula (6) in the general formula (5), the alkyl group having 1 to 8 carbon atoms, represented by $R^{16}$, is preferably methyl, ethyl, propyl, butyl or pentyl. In the general formula (5), the alkylene group having 1 to 3 carbon atoms, represented by $R^{13}$, is preferably a methylene group, an ethylene group or a propylene group, and the alkyl group having 1 to 8 carbon atoms, represented by $R^{14}$, is preferably methyl, ethyl, propyl, butyl or pentyl.

Examples of the hindered phenol derivative of the general formula (5) include 1,1,2,2-tetrakis(5-cyclohexyl-4-hydroxy-2-methylphenyl)ethane, 1,1,2,2-tetrakis(3-phenyl-4-hydroxyphenyl)ethane, 1,1,2,2-tetrakis(3-tert-butyl-4-hydroxyphenyl)ethane, 1,1,3-tris(3-cyclohexyl-4-hydroxyphenyl)butane, 1,1,3-tris(5-cyclohexyl-4-hydroxy-2-methylphenyl)butane, 1,1,3-tris(3-cyclohexyl-4-hydroxy-5-methylphenyl)butane, 1,1,3-tris(3-phenyl-4-hydroxyphenyl)butane, 1,1,3-tris(5-phenyl-4-hydroxy-2-methylphenyl)butane, 1,1,3-tris(3-tert-butyl-4-hydroxyphenyl)butane, 1,1,3-tris(5-tert-butyl-4-hydroxy-2-methylphenyl)butane, 1,1,3,3-tetrakis(5-cyclohexyl-4-hydroxy-2-methylphenyl)propane, 1,1,3,3-tetrakis(3-cyclohexyl-4-hydroxyphenyl)propane, 1,1,5,5-tetrakis(5-cyclohexyl-4-hydroxy-2-methylphenyl)pentane, 1,1,3,3-tetrakis(3-cyclohexyl-4-hydroxyphenyl)pentane, 1,1,3,3-tetrakis(3-phenyl-4-hydroxyphenyl)propane, 1,1,3,3-tetrakis(5-phenyl-4-hydroxy-2-methylphenyl)propane, 1,1,3,3-tetrakis(3-tert-butyl-4-hydroxyphenyl)propane and 1,1,3,3-tetrakis(5-tert-butyl-4-hydroxy-2-methylphenyl) propane, while the compound of the general formula (5) shall not be limited thereto. These compounds may be used alone or in combination as required.

Of the above hindered phenol derivatives of the general formula (5), 1,1,3-tris(5-cyclohexyl-4-hydroxy-2-methylphenyl)butane, 1,1,3-tris(3-tert-butyl-4-hydroxy-2-methylphenyl)butane are particularly preferred, since they produce a large effect on improvement in the retainability of a colored-formed image portion against heat.

The amount of the hindered phenol derivative of the general formula (5) based on the electron-accepting developer is preferably 1 to 30% by weight, more preferably 3 to 10% by weight.

When the amount of the hindered phenol derivative of the general formula (5) based on the electron-accepting developer is less than 1% by weight, there is produced little effect on improvements in image retainability. When it exceeds 30% by weight, the hindered phenol derivative inhibits a contact between the electron-donating dye precursor and the electron-accepting developer and is liable to cause a decrease in the property of thermal response.

In the thermal recording material of the present invention, thermal recording layer may optionally contain a hindered amine derivative of the general formula (7),

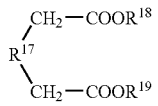

wherein $R^{17}$ is a covalent bond, an alkylene group having 1 to 8 carbon atoms or a group of the general formula (8),

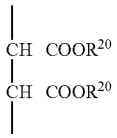

(8)

in which $R^{20}$ is 2,2,6,6-tetramethyl-4-piperidyl or 1,2,2,6,6-pentamethyl-4-piperidyl, each of $R^{18}$ and $R^{19}$ may the same as, or different from, other and is 2,2,6,6-tetramethyl-4-piperidyl or 1,2,2,6,6-pentamethyl-4-piperidyl, and in this case, there can be thereby obtained a thermal recording material that is improved in retainability stability of an image portion against temperatures.

Examples of the hindered amine derivative of the general formula (7) include bis(2,2,6,6-tetramethyl-4-piperidyl) sebacate, bis(2,2,6,6-tetramethyl-4-piperidyl) succinic acid ester, tetrakis(1,2,2,6,6-pentamethyl(4-piperidyl)) butane-1,2,3,4-tetracarboxylic acid ester and tetrakis(2,2,6,6-tetramethyl(4-piperidyl)) butane-1,2,3,4-tetracarboxylic acid ester, while the compound of the general formula (7) shall not be limited thereto. These compounds may be used alone or in combination as required.

Of the above hindered amine derivatives of the general formula (7), particularly, tetrakis(1,2,2,6,6-pentamethyl(4-piperidyl))-butane-1,2,3,4-tetracarboxylic acid ester and tetrakis(2,2,6,6-tetramethyl(4-piperidyl))-butane-1,2,3,4-tetracarboxylic acid ester are particularly preferred, since they have a large effect on improvements in retainability of a color-formed image portion against heat.

The amount of the hindered amine derivative of the general formula (7) based on the electron-accepting developer is preferably 1 to 30% by weight, more preferably 3 to 10% by weight.

When the amount of the hindered amine derivative of the general formula (7) based on the electron-accepting developer is less than 1% by weight, there is produced little effect on improvements in image retainability. When it exceeds 30% by weight, the hindered amine derivative inhibits a contact between the electron-donating dye precursor and the electron-accepting developer and is liable to cause a decrease in the property of thermal response.

The thermal recording material of the present invention contains, as essential components, the generally colorless or light-colored electron-donating dye precursor, the electron-accepting developer and the amide derivative as a sensitizer, and these components are dispersed in a binder. Then, the thus-prepared dispersion is applied onto a substrate to form the thermal recording layer, and the thermal recording layer is heated with a thermal head, a hot pen or a laser beam, whereby the dye precursor and the electron-accepting developer readily react with each other to give a recorded image. Further, the thermal recording layer contains a pigment, a binder, an anti-oxidant, a sticking preventer, etc., as required.

In the thermal recording material of the present invention, the thermal recording layer contains the fluorane derivative of the general formula (3) as a dye precursor, while a dye precursor other than the compound of the general formula (3) may be incorporated together with the dye precursor of the general formula (3) that is an essential component, so long as the effect of the invention is not impaired. The above dye precursor can be selected from those that are generally used in a thermal recording material or a pressure-sensitive recording material, while the other dye precursor above shall not be limited thereto.

Examples of the dye precursor different from the compound of the above general formula (3) are as follows. That is, examples of the dye precursor different from the compound of the above general formula (3) include (1) Triarylmethane compounds; 3,3-bis(p-dimethylaminophenyl)-6-dimethylaminophthalide (Crystal Violet Lactone), 3,3-bis(p-dimethylaminophenyl) phthalide, 3-(p-dimethylaminophenyl)-3-(1,2-dimethylindol-3-yl) phthalide, 3-(p-dimethylaminophenyl)-3-(2-methylindol-3-yl) phthalide, 3-(p-dimethylaminophenyl)-3-(2-phenylindol-3-yl) phthalide, 3,3-bis(1,2-dimethylindol-3-yl)-5-dimethylaminophthalide, 3,3-bis(1,2-dimethylindol-3-yl)-6-dimethylaminophthalide, 3,3-bis(9-ethylcarbazol-3-yl)-5-dimethylaminophthalide, 3,3-bis(2-phenylindol-3-yl)-5-dimethylaminophthalide, 3-p-dimethylaminophenyl-3-(1-methylpyrol-2-yl)-6-dimethylaminophthalide, etc., (2) Diphenylmethane compounds; 4,4'-bis(dimethylaminophenyl)benzhydrylbenzyl ether, N-chlorophenylleucoauramine, N-2,4,5-trichlorophenylluecoauramine, etc.

(3) Xanthene compounds; rhodamine B anilinolactam, rhodamine B-p-chloroanilinolactam, 3-diethylamino-7-benzylaminofluorane, 3-diethylamino-7-octylaminofluorane, 3-diethylamino-7-phenylfluorane, 3-diethylamino-7-chlorofluorane, 3-diethylamino-6-chloro-7-methylfluorane, 3-diethylamino-7-(3,4-dichloroanilino)fluorane, 3-(N-ethyl-N-tolyl)amino-6-methyl-7-phenethylfluorane, etc.

(4) Thiazine compounds; Benzoylluecomethylene blue, p-nitrobenzoylleucomethylene blue, etc.

(5) Spiro compounds; 3-methylspironaphthopyran, 3-ethylspirodinaphthopyran, 3,3'-dichlorospirodinaphthopyran, 3-benzylspirodinaphthopyran, 3-methylnaphtho-(3-methoxybenzo)spiropyran, 3-propylspirobenzopyran, etc. These dye precursors may be used alone or in combination.

In the thermal recording material of the present invention, as an electron-accepting developer that causes the dye precursor to form a color, the thermal recording layer may contain an electron-accepting developer other than the compound of the general formula (1) together with the compound of the general formula (1) so long as the effect of the present invention is not impaired. The other electron-accepting developer above can be selected from those that are generally used in a thermal recording material or a pressure-sensitive recording material, while the other electron-accepting developer above shall not be limited thereto. Examples of these electron-accepting developers include a phenol derivative, an aromatic carboxylic acid derivative, an N,N'-diarylthiourea derivative, an arylsulfonylurea derivative and polyvalent metal salts such as a zinc salt of an organic compound.

Examples of the electron-accepting developers other than the compound of the above general formula (1) include 4-hydroxy-4'-isopropoxydiphenylsulfone, 4-hydroxy-4'-benzyloxydiphenylsulfone, 4-hydroxy-4'-propoxydiphenylsulfone, 4-hydroxy-4'-benzenesulfonyloxydiphenylsulfone, p-phenylphenol, p-hydroxyacetophenone, 4-hydroxy-4'-benzenesulfonyloxydiphenylsulfone, 1,1-bis(p-hydroxyphenyl)propane, 1,1-bis(p-hydroxyphenyl)pentane, 1,1-bis(p-hydroxyphenyl)hexane, 1,1-bis(p-hydroxyphenyl) cyclohexane, 2,2-bis(p-hydroxyphenyl)propane, 2,2-bis(p-hydroxyphenyl)hexane, 1,1-bis(p-hydroxyphenyl)-2-ethylhexane, 2,2-bis(3-chloro-4-hydroxyphenyl)propane, 1,1-bis(p-hydroxyphenyl)-1-phenylethane, 1,3-di-[2-(p-hydroxyphenyl)-2-propyl]benzene, 1,3-di-[2-(3,4-dihydroxyphenyl)-2-propyl]benzene, 1,4-di-[2-(p-hydroxyphenyl)-2-propyl]benzene, 4,4'-hydroxyphenyl ether, 3,3'-dichloro-4,4'-hydroxydiphenyl sulfide, methyl 2,2-bis(4-hydroxyphenyl)acetate, butyl 2,2-bis(4-hydroxyphenyl) acetate, 4,4'-thiobis(2-tert-butyl-5-methylphenol), dimethyl 4-hydroxyphthalate, benzyl gallate, stearyl gallate, N,N'-diphenylthiourea, 4,4'-bis(3-(4-methylphenylsulfonyl)ureido)diphenylmethane, N-(4-methylphenylsulfonyl)-N'-phenylurea, N-(4-methylphenylsulfonyl)-N'-(3-(4-methylphenylsulfonyloxy)phenyl)urea, salicylanilide, 5-chlorosalicylanilide, salicylic acid, 3,5-di-tert-butylsalicyclic acid, 3,5-di-α-methylbenzylsalicyclic acid, 4-[2'-(4-methoxyphenoxy)ethyloxy)salicylic acid and metal salts of these salicylic acid derivatives.

In the thermal recording material of the present invention, as a heat-fusible sensitizer, the thermal recording layer may contain other heat-fusible compound as required together with the compound of the general formula (2) so long as the effect of the present invention is not impaired. The "other" heat-fusible compound preferably has a melting point of 60 to 180° C., more preferably has a melting point of 80 to 140° C.

Specific examples of the above heat-fusible compound include known heat-fusible compounds such as synthetic and natural waxes such as paraffin wax, microcrystalline wax, polyethylene wax and carnauba wax; ether compounds such as bis(4-methoxyphenyl) ether, 2,2'-bis(4-methoxyphenoxy)diethyl ether, 1,2-bis(3-methoxyphenoxy)ethane, a naphthyl ether derivative, an anthryl ether derivative and aliphatic ether; ester compounds such as diphenyl adipate, dibenzyl oxalate, di(4-chlorobenzyl) oxalate, diphenyl carbonate, dimethyl terephthalate, phenyl benzenesulfonate and 4-acetylacetophenone; biphenyl derivatives such as m-terphenyl, 4-benzylbiphenyl, 4-acetylbiphenyl and 4-allyloxybiphenyl; bis(4-allyloxyphenyl)sulfone; acetoacetic acid anilide; and fatty acid anilides, while the above heat-fusible compound shall not be limited thereto. These compounds may be used alone or in combination.

In the thermal recording material of the present invention, the pigment for use in the thermal recording layer includes inorganic and organic pigments such as diatomite, talc, kaolin, calcined kaolin, calcium carbonate, magnesium carbonate, titanium oxide, zinc oxide, silicon oxide, aluminum hydroxide and a urea-formalin resin.

In the thermal recording material of the present invention, the binder for use in the thermal recording layer includes water-soluble binders such as starches, hydroxyethyl cellulose, methyl cellulose, carboxymethyl cellulose, gelatin, casein, polyvinyl alcohol, denatured polyvinyl alcohol, sodium polyacrylate, an acrylic acid amide/acrylic acid ester copolymer, an acrylic acid amide/acrylic acid ester/methacrylic acid terpolymer, an alkali salt of a styrene/maleic anhydride copolymer and an alkali salt of an ethylene/maleic anhydride copolymer, and latexes such as polyvinyl acetate, polyurethane, polyacrylic ester, a styrene/butadiene copolymer, an acrylonitrile/butadiene copolymer, a methyl acrylate/butadiene copolymer and an ethylene/vinyl acetate copolymer.

As other additives, there may be added higher fatty acid metal salts such as zinc stearate and calcium stearate and waxes such as paraffin, paraffin oxide, polyethylene, polyethylene oxide, stearamide and castor wax for preventing the abrasion and sticking of a thermal printing head as required. Further, a dispersing agent such as sodium dioctylsulfosuccinate and a benzophenone or benzotriazole ultraviolet absorbent may be added as required. Further, a surfactant and a fluorescence dye may be added as required.

Paper is mainly used as a substrate for use in the thermal recording material of the present invention. A non-woven fabric, a plastic film, a synthetic paper, a metal foil or composite sheets of these may be used as required. Further, there may be employed various known techniques in the production of thermal recording materials, in which an overcoat layer made of a single layer or a plurality of layers is formed for protecting the thermal recording layer, or in which an undercoat layer made of a single or a plurality of layers of a pigment or a resin is formed between the thermal recording layer and the substrate.

The application amount of the thermal recording layer is determined depending upon the amounts of the dye precursor as a color-forming component and the electron-accepting developer, and generally, the application amount of the dye precursor is properly 0.1 to 1.0 g/m$^2$. The amount of the electron-accepting developer based on the dye precursor is generally in the range of 5 to 500% by weight, particularly preferably in the range of 20 to 400% by weight.

EXAMPLES

The present invention will be explained in detail with reference to Examples hereinafter, while the present invention shall not be limited by these Examples. In Examples, "part" and "%" are both based on weight, and application amounts refer to absolute dry weights.

(1) Preparation of Heat-Sensitive Coating Liquid

<Preparation of Dispersion>

Dispersions A to S were prepared by the following methods.

<Dispersion A>

200 Grams of 4,4'-dihydroxydiphenylsulfone was dispersed in a mixture of 200 g of a 10% sulfone-group-modified polyvinyl alcohol aqueous solution with 600 g of water, and the resultant mixture was milled with a bead mill until an average particle diameter of 1.0 μm was obtained, to give Dispersion A.

<Dispersion B>

200 Grams of 4-hydroxy-4'-isopropoxydiphenylsulfone was dispersed in a mixture of 200 g of a 10% sulfone-group-modified polyvinyl alcohol aqueous solution with 600 g of water, and the resultant mixture was milled with a bead mill until an average particle diameter of 1.0 μm was obtained, to give Dispersion B.

<Dispersion C>

200 Grams of 3-dibutylamino-6-methyl-7-anilinofluorane was dispersed in a mixture of 200 g of a 10% sulfone-group-modified polyvinyl alcohol aqueous solution with 600 g of water, and the resultant mixture was milled with a bead mill until an average particle diameter of 1.0 μm was obtained, to give Dispersion C.

<Dispersion D>

200 Grams of 3-diethylamino-6-chloro-7-(2-ethyloxyethylamino)fluorane was dispersed in a mixture of 200 g of a 10% sulfone-group-modified polyvinyl alcohol aqueous solution with 600 g of water, and the resultant mixture was milled with a bead mill until an average particle diameter of 1.0 μm was obtained, to give Dispersion D.

<Dispersion E>

100 Grams of stearic acid amide was dispersed in a mixture of 100 g of a 10% sulfone-group-modified polyvinyl alcohol aqueous solution with 800 g of water, and the resultant mixture was milled with a bead mill until an average particle diameter of 5.0 μm was obtained, to give Dispersion E.

<Dispersion F>

200 Grams of 2-benzyloxynaphthalene was dispersed in a mixture of 200 g of a 10% sulfone-group-modified polyvinyl alcohol aqueous solution with 600 g of water, and the resultant mixture was milled with a bead mill until an average particle diameter of 1.0 μm was obtained, to give Dispersion F.

<Dispersion G>

200 Grams of ethylene glycol di-m-tolyl ether was dispersed in a mixture of 200 g of a 10% sulfone-group-modified polyvinyl alcohol aqueous solution with 600 g of water, and the resultant mixture was milled with a bead mill until an average particle diameter of 1.0 μm was obtained, to give Dispersion G.

<Dispersion H>

200 Grams of bis(4-methylbenzyl)oxalate was dispersed in a mixture of 200 g of a 10% sulfone-group-modified polyvinyl alcohol aqueous solution with 600 g of water, and the resultant mixture was milled with a bead mill until an average particle diameter of 1.0 μm was obtained, to give Dispersion H.

<Dispersion I>

200 Grams of 1,2-bis(phenoxymethyl)benzene was dispersed in a mixture of 200 g of a 10% sulfone-group-modified polyvinyl alcohol aqueous solution with 600 g of water, and the resultant mixture was milled with a bead mill until an average particle diameter of 1.0 μm was obtained, to give Dispersion I.

<Dispersion J>

200 Grams of p-acetotoluidine was dispersed in a mixture of 200 g of a 10% sulfone-group-modified polyvinyl alcohol aqueous solution with 600 g of water, and the resultant mixture was milled with a bead mill until an average particle diameter of 1.0 μm was obtained, to give Dispersion J.

<Dispersion K>

200 Grams of 4-(4-methylphenoxy)biphenyl was dispersed in a mixture of 200 g of a 10% sulfone-group-modified polyvinyl alcohol aqueous solution with 600 g of water, and the resultant mixture was milled with a bead mill until an average particle diameter of 1.0 μm was obtained, to give Dispersion K.

<Dispersion L>

200 Grams of 4-acetylbiphenyl was dispersed in a mixture of 200 g of a 10% sulfone-group-modified polyvinyl alcohol aqueous solution with 600 g of water, and the resultant mixture was milled with a bead mill until an average particle diameter of 1.0 μm was obtained, to give Dispersion L.

<Dispersion M>

200 Grams of sodium salt of 2,2'-methylenebis(4,6-di-tert-butylphenyl)phosphate was dispersed in a mixture of 200 g of a 10% sulfone-group-modified polyvinyl alcohol aqueous solution with 600 g of water, and the resultant mixture was milled with a bead mill until an average particle diameter of 1.0 μm was obtained, to give Dispersion M.

<Dispersion N>

200 Grams of 1,1,3-tris(2-methyl-4-hydroxy-5-cyclohexylphenyl)butane was dispersed in a mixture of 200 g of a 10% sulfone-group-modified polyvinyl alcohol aqueous solution with 600 g of water, and the resultant mixture was milled with a bead mill until an average particle diameter of 1.0 μm was obtained, to give Dispersion N.

<Dispersion O>

200 Grams of butane-1,2,3,4-tetracarboxylic acid-tetrakis (1,2,2,6,6-pentamethyl(4-piperidyl) ester was dispersed in a mixture of 200 g of a 10% sulfone-group-modified polyvinyl alcohol aqueous solution with 600 g of water, and the resultant mixture was milled with a bead mill until an average particle diameter of 1.0 μm was obtained, to give Dispersion O.

<Dispersion P>

200 Grams of aluminum hydroxide was dispersed in 800 g of a 0.5% sodium polyacrylate aqueous solution, and the mixture was stirred with a homo-mixer for 10 minutes, to give Dispersion P.

<Dispersion Q>

200 Grams of 2,4'-dihydroxydiphenylsulfone was dispersed in a mixture of 200 g of a 10% sulfone-group-modified polyvinyl alcohol aqueous solution with 600 g of water, and the resultant mixture was milled with a bead mill until an average particle diameter of 1.0 μm was obtained, to give Dispersion Q.

<Dispersion R>

200 Grams of 3-(N-ethyl-N-isoamyl)amino-6-methyl-7-anilinofluorane was dispersed in a mixture of 200 g of a 10% sulfone-group-modified polyvinyl alcohol aqueous solution with 600 g of water, and the resultant mixture was milled with a bead mill until an average particle diameter of 1.0 μm was obtained, to give Dispersion R.

<Dispersion S>

200 Grams of 3-dipentylamino-6-methyl-7-anilinofluorane was dispersed in a mixture of 200 g of a 10% sulfone-group-modified polyvinyl alcohol aqueous solution with 600 g of water, and the resultant mixture was milled with a bead mill until an average particle diameter of 1.0 μm was obtained, to give Dispersion S.

Table 1 shows kinds, compound names, concentrations and particle diameters of main components of Dispersions A to S.

TABLE 1

| Name | Kind | Compound | Concentration % | Particle diameter μm |
|---|---|---|---|---|
| Dispersion A | Developer | 4,4'-dihydroxydiphenylsulfone | 20 | 1.0 |
| Dispersion B | Developer | 4-hydroxy-4'-isopropoxydiphenylsulfone | 20 | 1.0 |
| Dispersion C | Dye | 3-dibutylamino-6-methyl-7-anilinofluorane | 20 | 1.0 |
| Dispersion D | Dye | 3-diethylamino-6-chloro-7-(2-ethyloxyethylamino) fluorane | 20 | 1.0 |
| Dispersion E | Sensitizer | Stearic acid amide | 10 | 5.0 |
| Dispersion F | Sensitizer | 2-benzyloxynaphthalene | 20 | 1.0 |
| Dispersion G | Sensitizer | Ethylene glycol di-m-tolyl ether | 20 | 1.0 |
| Dispersion H | Sensitizer | bis(4-methylbenzyl) oxalate | 20 | 1.0 |
| Dispersion I | Sensitizer | 1,2-bis(phenoxymethyl)benzene | 20 | 1.0 |
| Dispersion J | Sensitizer | p-acetotoluidine | 20 | 1.0 |
| Dispersion K | Sensitizer | 4-(4-methylphenoxy)biphenyl | 20 | 1.0 |
| Dispersion L | Sensitizer | 4-acetylbiphenyl | 20 | 1.0 |
| Dispersion M | Additive | sodium salt of 2,2'-methylenebis(4,6-di-tert-butylphenyl)phosphate | 20 | 1.0 |
| Dispersion N | Additive | 1,1,3-tris(2-methyl-4-hydoxy-5-cyclohexylphenyl)butane | 20 | 1.0 |
| Dispersion O | Additive | tetrakis(1,2,2,6,6-pentamethyl(4-piperidyl)-butane-1,2,3,4-tetracarborxylate | 20 | 1.0 |
| Dispersion P | Pigment | aluminum hydroxide | 20 | — |
| Dispersion Q | Developer | 2,4'-dihydroxydiphenylsulfone | 20 | 1.0 |
| Dispersion R | Dye | 3-(N-ethyl-N-isoamyl)amino-6-methyl-7-anilinofluorane | 20 | 1.0 |
| Dispersion S | Dye | 3-dipentylamino-6-methyl-7-anilinofluorane | 20 | 1.0 |

Example 1

(1) Preparation of Heat-Sensitive Coating Liquid

Various dispersions prepared above, other dispersions and an aqueous solution were mixed in the following amount ratios, and water was added such that a coating liquid had a concentration of 15%. The mixture was fully stirred to give a heat-sensitive coating liquid.

| | |
|---|---|
| Dispersion A | 60 parts |
| Dispersion C | 30 parts |
| Dispersion E | 60 parts |
| Dispersion P | 100 parts |
| 40% Zinc stearate aqueous solution | 25 parts |
| 10% Polyvinyl alcohol aqueous solution | 272 parts |
| Water | 300 parts |

(2) Preparation of Heat-Sensitive Coated Paper

A coating liquid having the following composition was coated on a woodfree paper having a basis weight of 40 g/m$^2$ to form a coating having a solid application amount of 9 g/m$^2$, and the coating was dried to give a coated paper for heat-sensitive coating.

| | |
|---|---|
| Calcined kaolin | 100 parts |
| 50% Styrene-butadiene latex aqueous dispersion | 24 parts |
| Water | 200 parts |

(3) Preparation of Thermal Recording Material

The heat-sensitive coating liquid prepared in (1) was applied onto the coated paper for heat-sensitive coating prepared in (2) to form a coating having a solid application amount of 4 g/m$^2$, and the coating was dried to obtain a thermal recording material.

Example 2

A thermal recording material was obtained in the same manner as in Example 1 except that the amount of Dispersion E was changed from 60 parts to 120 parts.

Example 3

A thermal recording material was obtained in the same manner as in Example 1 except that the amount of Dispersion E was changed from 60 parts to 240 parts.

Example 4

A thermal recording material was obtained in the same manner as in Example 1 except that the amount of Dispersion E was changed from 60 parts to 100 parts and that 50 parts of Dispersion F was added.

Example 5

A thermal recording material was obtained in the same manner as in Example 1 except that the amount of Dispersion E was changed from 60 parts to 100 parts and that 50 parts of Dispersion G was added.

Example 6

A thermal recording material was obtained in the same manner as in Example 1 except that the amount of Dispersion E was changed from 60 parts to 100 parts and that 50 parts of Dispersion H was added.

Example 7

A thermal recording material was obtained in the same manner as in Example 1 except that the amount of Dispersion E was changed from 60 parts to 100 parts and that 50 parts of Dispersion I was added.

Example 8

A thermal recording material was obtained in the same manner as in Example 1 except that the amount of Dispersion E was changed from 60 parts to 100 parts and that 50 parts of Dispersion J was added.

Example 9

A thermal recording material was obtained in the same manner as in Example 1 except that the amount of Dispersion E was changed from 60 parts to 100 parts and that 50 parts of Dispersion K was added.

Example 10

A thermal recording material was obtained in the same manner as in Example 1 except that 70 parts of Dispersion F was added.

Example 11

A thermal recording material was obtained in the same manner as in Example 1 except that the amount of Dispersion E was changed from 60 parts to 80 parts and that 60 parts of Dispersion F was added.

Example 12

A thermal recording material was obtained in the same manner as in Example 1 except that the amount of Dispersion E was changed from 60 parts to 160 parts and that 20 parts of Dispersion F was added.

Example 13

A thermal recording material was obtained in the same manner as in Example 1 except that the amount of Dispersion E was changed from 60 parts to 180 parts and that 10 parts of Dispersion F was added.

Example 14

A thermal recording material was obtained in the same manner as in Example 1 except that the amount of Dispersion E was changed from 60 parts to 200 parts and that 50 parts of Dispersion J was added.

Example 15

A thermal recording material was obtained in the same manner as in Example 1 except that the amount of Dispersion E was changed from 60 parts to 100 parts and that 100 parts of Dispersion J was added.

Example 16

A thermal recording material was obtained in the same manner as in Example 1 except that the amount of Dispersion E was changed from 60 parts to 100 parts and that 50 parts of Dispersion F and 3 parts of Dispersion M were added.

Example 17

A thermal recording material was obtained in the same manner as in Example 1 except that the amount of Dispersion E was changed from 60 parts to 100 parts and that 50 parts of Dispersion F and 3 parts of Dispersion N were added.

Example 18

A thermal recording material was obtained in the same manner as in Example 1 except that the amount of Dispersion E was changed from 60 parts to 100 parts and that 50 parts of Dispersion F and 3 parts of Dispersion O were added.

Example 19

A thermal recording material was obtained in the same manner as in Example 1 except that the amount of Dispersion E was changed from 60 parts to 100 parts and that 50 parts of Dispersion F, 3 parts of Dispersion M and 3 parts of Dispersion N were added.

Example 20

A thermal recording material was obtained in the same manner as in Example 1 except that the amount of Dispersion E was changed from 60 parts to 100 parts and that 50 parts of Dispersion F, 3 parts of Dispersion M and 3 parts of Dispersion O were added.

Example 21

A thermal recording material was obtained in the same manner as in Example 1 except that the amount of Dispersion E was changed from 60 parts to 100 parts and that 50 parts of Dispersion F, 3 parts of Dispersion N and 3 parts of Dispersion O were added.

Example 22

A thermal recording material was obtained in the same manner as in Example 4 except that the amount of Dispersion A was changed from 60 parts to 50 parts and that 10 parts of Dispersion Q was added.

Example 23

A thermal recording material was obtained in the same manner as in Example 5 except that the amount of Dispersion C was changed from 30 parts to 20 parts and that 10 parts of Dispersion R was added.

Example 24

A thermal recording material was obtained in the same manner as in Example 7 except that Dispersion C was replaced with Dispersion S.

Comparative Example 1

A thermal recording material was obtained in the same manner as in Example 1 except that the amount of Dispersion E was changed from 60 parts to 40 parts.

Comparative Example 2

A thermal recording material was obtained in the same manner as in Example 1 except that the amount of Dispersion E was changed from 60 parts to 300 parts.

Comparative Example 3

A thermal recording material was obtained in the same manner as in Example 1 except that Dispersion E was replaced with Dispersion F.

Comparative Example 4

A thermal recording material was obtained in the same manner as in Example 1 except that Dispersion E was replaced with Dispersion G.

Comparative Example 5

A thermal recording material was obtained in the same manner as in Example 1 except that Dispersion E was replaced with Dispersion H.

Comparative Example 6

A thermal recording material was obtained in the same manner as in Example 1 except that Dispersion E was replaced with Dispersion I.

Comparative Example 7

A thermal recording material was obtained in the same manner as in Example 1 except that Dispersion E was replaced with Dispersion J.

Comparative Example 8

A thermal recording material was obtained in the same manner as in Example 1 except that Dispersion E was replaced with Dispersion K.

Comparative Example 9

A thermal recording material was obtained in the same manner as in Example 1 except that Dispersion E was replaced with Dispersion L.

Comparative Example 10

A thermal recording material was obtained in the same manner as in Example 2 except that Dispersion A in Example 1 was replaced with Dispersion B.

Comparative Example 11

A thermal recording material was obtained in the same manner as in Example 2 except that Dispersion C in Example 1 was replaced with Dispersion D.

Comparative Example 12

A thermal recording material was obtained in the same manner as in Example 4 except that Dispersion C was replaced with Dispersion D.

Comparative Example 13

A thermal recording material was obtained in the same manner as in Example 4 except that Dispersion A was replaced with Dispersion B.

Comparative Example 14

A thermal recording material was obtained in the same manner as in Example 5 except that Dispersion A was replaced with Dispersion B.

Comparative Example 15

A thermal recording material was obtained in the same manner as in Example 6 except that Dispersion A was replaced with Dispersion B.

Comparative Example 16

A thermal recording material was obtained in the same manner as in Example 7 except that Dispersion A was replaced with Dispersion B.

Comparative Example 17

A thermal recording material was obtained in the same manner as in Example 8 except that Dispersion A was replaced with Dispersion B.

Comparative Example 18

A thermal recording material was obtained in the same manner as in Example 9 except that Dispersion A was replaced with Dispersion B.

Tables 2, 3, 4 and 5 shows main components of heat-sensitive coating liquids prepared in Examples 1 to 24 and Comparative Examples 1 to 18.

TABLE 2

| | Developer | | Sensitizer | | | Dye precursor | | |
|---|---|---|---|---|---|---|---|---|
| | GF (1) | Other | GF (2) | Other | (1)/(2)* | GF (3) | Other | Other additives |
| Ex. 1 | Disp. A | — | Disp. E | — | 6/3 | Disp. C | — | |
| Ex. 2 | Disp. A | — | Disp. E | — | 6/6 | Disp. C | — | |
| Ex. 3 | Disp. A | — | Disp. E | — | 6/12 | Disp. C | — | |
| Ex. 4 | Disp. A | — | Disp. E | Disp. F | 6/5 | Disp. C | — | |
| Ex. 5 | Disp. A | — | Disp. E | Disp. G | 6/5 | Disp. C | — | |
| Ex. 6 | Disp. A | — | Disp. E | Disp. H | 6/5 | Disp. C | — | |
| Ex. 7 | Disp. A | — | Disp. E | Disp. I | 6/5 | Disp. C | — | |
| Ex. 8 | Disp. A | — | Disp. E | Disp. J | 6/5 | Disp. C | — | |
| Ex. 9 | Disp. A | — | Disp. E | Disp. K | 6/5 | Disp. C | — | |
| Ex. 10 | Disp. A | — | Disp. E | Disp. F | 6/3 | Disp. C | — | |
| Ex. 11 | Disp. A | — | Disp. E | Disp. F | 6/4 | Disp. C | — | |
| Ex. 12 | Disp. A | — | Disp. E | Disp. F | 6/8 | Disp. C | — | |

Ex. = Example, GF = General formula, Disp. = dispersion
*Weight ratio of developer of general formula (1) and sensitizer of general formula (2)

TABLE 3

| | Developer | | Sensitizer | | | Dye precursor | | |
|---|---|---|---|---|---|---|---|---|
| | GF (1) | Other | GF (2) | Other | (1)/(2)* | GF(3) | Other | Other additives |
| Ex. 13 | Disp. A | — | Disp. E | Disp. F | 6/9 | Disp. C | — | |
| Ex. 14 | Disp. A | — | Disp. E | Disp. J | 6/10 | Disp. C | — | |
| Ex. 15 | Disp. A | — | Disp. E | Disp. J | 6/5 | Disp. C | — | |
| Ex. 16 | Disp. A | — | Disp. E | Disp. F | 6/5 | Disp. C | — | Disp. M |
| Ex. 17 | Disp. A | — | Disp. E | Disp. F | 6/5 | Disp. C | — | Disp. N |
| Ex. 18 | Disp. A | — | Disp. E | Disp. F | 6/5 | Disp. C | — | Dips. O |
| Ex. 19 | Disp. A | — | Disp. E | Disp. F | 6/5 | Disp. C | — | Disp. M Disp. N |
| Ex. 20 | Disp. A | — | Disp. E | Disp. F | 6/5 | Disp. C | — | Disp. M Disp. O |
| Ex. 21 | Disp. A | — | Disp. E | Disp. F | 6/5 | Disp. C | — | Disp. N Disp. O |
| Ex. 22 | Disp. A<br>Disp. Q | — | Disp. E | Disp. F | 6/5 | Disp. C | — | |
| Ex. 23 | Disp. A | — | Disp. E | Disp. G | 6/5 | Disp. C<br>Disp. R | — | |
| Ex. 24 | Disp. A | — | Disp. E | Disp. I | 6/5 | Disp. S | — | |

Ex. = Example, GF = General formula, Disp. = dispersion
*Weight ratio of developer of general formula (1) and sensitizer of general formula (2)

TABLE 4

| | Developer | | Sensitizer | | | Dye precursor | | |
|---|---|---|---|---|---|---|---|---|
| | GF(1) | Other | GF(2) | Other | (1)/(2)* | GF(3) | Other | Other additives |
| CEx. 1 | Disp. A | — | Disp. E | — | 6/2 | Disp. C | — | |
| CEx. 2 | Disp. A | — | Disp. E | — | 6/15 | Disp. C | — | |
| CEx. 3 | Disp. A | — | — | Disp. F | — | Disp. C | — | |
| CEx. 4 | Disp. A | — | — | Disp. G | — | Disp. C | — | |
| CEx. 5 | Disp. A | — | — | Disp. H | — | Disp. C | — | |
| CEx. 6 | Disp. A | — | — | Disp. I | — | Disp. C | — | |
| CEx. 7 | Disp. A | — | — | Disp. J | — | Disp. C | — | |
| CEx. 8 | Disp. A | — | — | Disp. K | — | Disp. C | — | |
| CEx. 9 | Disp. A | — | — | Disp. L | — | Disp. C | — | |
| CEx. 10 | — | Disp. B | Disp. E | — | — | Disp. C | — | |
| CEx. 11 | Disp. A | — | Disp. E | — | 6/6 | — | Disp. D | |
| CEx. 12 | Disp. A | — | Disp. E | Disp. F | 6/5 | — | Disp. D | |

Ex. = Example, GF = General formula, Disp. = dispersion
*Weight ratio of developer of general formula (1) and sensitizer of general formula (2)

TABLE 5

| | Developer | | Sensitizer | | | Dye precursor | | |
|---|---|---|---|---|---|---|---|---|
| | GF(1) | Other | GF(2) | Other | (1)/(2)* | GF(3) | Other | Other additives |
| CEx. 13 | — | Disp. B | Disp. E | Disp. F | — | Disp. C | — | |
| CEx. 14 | — | Disp. B | Disp. E | Disp. G | — | Disp. C | — | |
| CEx. 15 | — | Disp. B | Disp. E | Disp. H | — | Disp. C | — | |
| CEx. 16 | — | Disp. B | Disp. E | Disp. I | — | Disp. C | — | |
| CEx. 17 | — | Disp. B | Disp. E | Disp. J | — | Disp. C | — | |
| CEx. 18 | — | Disp. B | Disp. E | Disp. K | — | Disp. C | — | |

Ex. = Example, GF = General formula, Disp. = dispersion
*Weight ratio of developer of general formula (1) and sensitizer of general formula (2)

The heat-sensitive recording materials obtained in the above Examples and Comparative Examples were calendered such that each heat-sensitive coating surface had a BEKK smoothness of 400 to 500 seconds, and evaluated as follows. Tables 6 and 7 show the evaluation results. Methods for the evaluations were as shown below.

[Thermal Response]

A printing test was carried out with a facsimile tester TH-PMD supplied by Okura Denki. A thermal head having a dot density of 8 dots/mm and a head resistance of 185 Ω was used, and printing was carried out at a head voltage of 12 V at a pulse width of 1.0 msec. An image obtained was measured for a color density with a Macbeth RD-918 reflection densitometer. Table 6 and Table 7 shows the evaluation results. It is required to attain a color density of at least 1.05 at a pulse width of 1.0 msec.

[Heat Resistance Test of Image Portion]

The thermal recording materials having images printed at 1.0 msec., used for the evaluation of thermal response, were stored at 60° C. for 24 hours and measured for a density in each image portion and a density in each non-printed ground portion with a Macbeth RD-918 reflection densitometer. Table 6 and Table 7 shows the evaluation results.

[Test on Adhering Residue]

No. 3 facsimile test chart of The Institute of Image Electronics Engineers of Japan was sent through a G3 thermal facsimile machine (KX-PW3TA, supplied by Matsushita Electric Industrial Co., Ltd.), and an image was continuously printed on the thus-obtained thermal recording material so that the thermal recording material had a length of 20 km. Then, a thermal head and a printed state were visually observed.

Evaluations were made on the basis of the following ratings.

5: No adhering residue was observed, and no blur on a printed image was observed.

4: Adhering residues were hardly observable, and no blur on a printed image was observed.

3: Adhering residues were observed, but no blur on a printed image was observed.

2. Adhering residues were observed, and light blurs caused on a printed image by them were observed.

1: Adhering residues in a large amount were observed, and heavy blurs caused on a printed image by them were observed.

TABLE 6

| | Thermal response | | Heat resistance (60° C.) | | Adhering |
|---|---|---|---|---|---|
| | Ground | Image | Ground | Image | residue* |
| Example 1 | 0.05 | 1.10 | 0.07 | 0.98 | 3 |
| Example 2 | 0.05 | 1.25 | 0.07 | 1.09 | 4 |
| Example 3 | 0.05 | 1.12 | 0.08 | 1.01 | 4 |
| Example 4 | 0.06 | 1.28 | 0.07 | 1.13 | 5 |
| Example 5 | 0.05 | 1.33 | 0.08 | 1.20 | 5 |
| Example 6 | 0.06 | 1.38 | 0.08 | 1.22 | 5 |
| Example 7 | 0.05 | 1.33 | 0.08 | 1.19 | 5 |
| Example 8 | 0.05 | 1.32 | 0.09 | 1.15 | 4 |
| Example 9 | 0.05 | 1.33 | 0.08 | 1.20 | 5 |
| Example 10 | 0.05 | 1.20 | 0.07 | 1.08 | 3 |
| Example 11 | 0.05 | 1.25 | 0.07 | 1.12 | 4 |
| Example 12 | 0.05 | 1.29 | 0.08 | 1.16 | 4 |
| Example 13 | 0.05 | 1.22 | 0.07 | 1.08 | 4 |
| Example 14 | 0.05 | 1.35 | 0.07 | 1.10 | 5 |
| Example 15 | 0.05 | 1.36 | 0.08 | 1.12 | 5 |
| Example 16 | 0.05 | 1.35 | 0.08 | 1.30 | 5 |

TABLE 6-continued

| | Thermal response | | Heat resistance (60° C.) | | Adhering |
|---|---|---|---|---|---|
| | Ground | Image | Ground | Image | residue* |
| Example 17 | 0.05 | 1.33 | 0.08 | 1.27 | 5 |
| Example 18 | 0.05 | 1.32 | 0.08 | 1.28 | 5 |
| Example 19 | 0.05 | 1.36 | 0.07 | 1.30 | 5 |
| Example 20 | 0.05 | 1.35 | 0.07 | 1.29 | 5 |
| Example 21 | 0.05 | 1.34 | 0.08 | 1.30 | 5 |
| Example 22 | 0.06 | 1.31 | 0.09 | 1.18 | 5 |
| Example 23 | 0.07 | 1.38 | 0.10 | 1.32 | 5 |
| Example 24 | 0.05 | 1.35 | 0.08 | 1.20 | 5 |

*The larger the value is, the smaller the amount of adhering residues is.

TABLE 7

| | Thermal response | | Heat resistance (60° C.) | | Adhering |
|---|---|---|---|---|---|
| | Ground | Image | Ground | Image | residue* |
| CEx. 1 | 0.05 | 0.88 | 0.07 | 0.73 | 3 |
| CEx. 2 | 0.05 | 0.95 | 0.07 | 0.74 | 3 |
| CEx. 3 | 0.05 | 1.05 | 0.08 | 0.89 | 2 |
| CEx. 4 | 0.05 | 1.08 | 0.08 | 0.90 | 2 |
| CEx. 5 | 0.05 | 1.10 | 0.08 | 0.94 | 2 |
| CEx. 6 | 0.05 | 1.08 | 0.07 | 0.92 | 2 |
| CEx. 7 | 0.05 | 1.08 | 0.08 | 0.92 | 2 |
| CEx. 8 | 0.05 | 1.09 | 0.07 | 0.92 | 1 |
| CEx. 9 | 0.05 | 1.11 | 0.08 | 0.94 | 1 |
| CEx. 10 | 0.05 | 1.25 | 0.08 | 1.09 | 1 |
| CEx. 11 | 0.05 | 1.10 | 0.07 | 0.80 | 1 |
| CEx. 12 | 0.05 | 1.20 | 0.08 | 1.00 | 1 |
| CEx. 13 | 0.05 | 1.20 | 0.07 | 0.96 | 1 |
| CEx. 14 | 0.05 | 1.25 | 0.08 | 0.98 | 1 |
| CEx. 15 | 0.05 | 1.22 | 0.07 | 0.93 | 1 |
| CEx. 16 | 0.05 | 1.21 | 0.08 | 0.92 | 1 |
| CEx. 17 | 0.05 | 1.22 | 0.07 | 0.93 | 1 |
| CEx. 18 | 0.05 | 1.20 | 0.08 | 0.92 | 1 |

CEx. = Comparative Example
*The larger the value is, the smaller the amount of adhering residues is.

As is shown in Tables 6 and 7, the thermal recording materials of Examples 1 to 24 are excellent over the thermal recording materials of Comparative Examples 1 to 18 in thermal response of ground/image, heat resistance and the property of prevention of adhering residues. That is, while the thermal response data and the heat resistance data in Examples are 1.10 to 1.38 and 0.98 to 1.32 respectively, those in Comparative Examples are 0.88 to 1.25 and 0.73 to 1.09 respectively, so that the data in Examples are excellent over those in Comparative Examples. Further, the thermal recording materials are compared in adherence of residues, all of the thermal recording materials of Examples show ratings of 3 or higher (most of them showed a rating of 4 or 5), while most of the counterparts in Comparative Examples show a rating of 1 or 2, or the amount of adhering residues is large, so that they are poor for practical use. Therefore, the thermal recording materials of Examples are highly evaluated with regard to thermal response, heat resistance and the property of prevention of adherence of residues and are highly valuable in practical use. The thermal recording materials of Examples 16 to 23 are particularly well balanced among their properties and highly evaluated as a whole.

INDUSTRIAL UTILITY

As is clearly shown in Tables 4 and 5, the thermal recording material of the present invention having the thermal recording layer containing the specified diphenylsulfone derivative, the specified amide derivative and the specified fluorane derivative as essential components is excellent in the property of thermal response and image retainability, generates fewer residues that adhere to a thermal head, and causes no printing failure in long-distance printing. Further, by incorporating the specified phosphoric ester derivative, the hindered phenol derivative, the specified hindered amine derivative into the thermal recording layer, further, there can be obtained a thermal recording material that is well-balanced among the property of thermal response and the property of retention of an image portion.

What is claimed is:

1. A thermal recording material having a thermal recording layer comprising a generally colorless or light-colored electron-donating dye precursor and an electron-accepting developer that reacts under heat to cause said dye precursor to form a color, said thermal recording layer comprising:

4,4'-dihydroxydiphenylsulfone (1), an amide derivative of the general formula (2), (2)

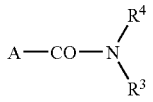

wherein A is an alkyl group, an alkenyl group or an alkylamino group, each of $R^3$ and $R^4$ may be the same as, or different from, other and is a hydrogen atom, an alkyl group, an alkenyl group, an aralkyl group or an aryl group, and a fluorane derivative of the general formula (3), (3)

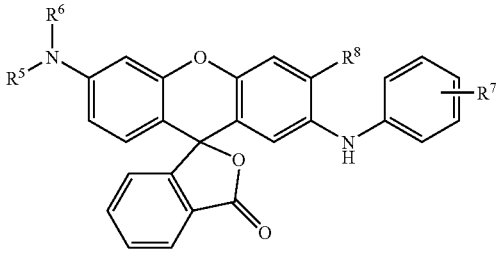

wherein each $R^5$ and $R^6$ may be the same as, or different from, other and is an alkyl group having 1 to 5 carbon atoms, a cyclohexyl group or an aryl group, $R^7$ is a hydrogen atom, methyl, trifluoromethyl or a halogen atom and $R^8$ is a hydrogen atom, methyl or a halogen atom, wherein the weight ratio of the 4,4'-dihydroxydiphenylsulfone (1) and the amide derivative of the general formula (2) (compound (1)/compound (2)) is 2/1 to 1/2, and wherein said thermal recording layer comprises at least one compound selected from the group consisting of a compound of the general formula (4), a compound of the general formula (5), and a compound of the general formula (7), wherein the compound of the general formula (4) is (4)

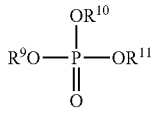

wherein each of $R^9$, $R^{10}$ and $R^{11}$ may be the same as, or different from, each other and is a hydrogen atom, an alkyl group, an alkenyl group, an aryl group, an aralkyl group, an alkali metal, an alkaline earth metal, a transition metal or an amine, and any two substituents of $R^9$, $R^{10}$ and $R^{11}$ may bond to each other and form a ring, wherein the compound of the general formula (5) is (5)

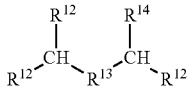

wherein $R^{12}$ is a group of the general formula (6), (6)

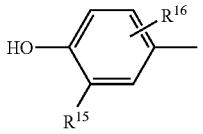

in which $R^{15}$ is cyclohexyl, phenyl or tert-butyl and $R^{16}$ is a hydrogen atom, an alkyl group having 1 to 8 carbon atoms, cyclohexyl, phenyl or tert-butyl, $R^{13}$ is a covalent bond or an alkylene group having 1 to 3 carbon atoms and $R^{14}$ is a hydrogen atom, an alkyl group having 1 to 8 carbon atoms or any group represented by $R^{12}$, and wherein the compound of the general formula (7) is

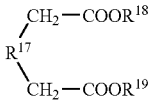

wherein $R^{17}$ is a covalent bond, an alkylene group having 1 to 8 carbon atoms or a group of the general formula (8).

(1)

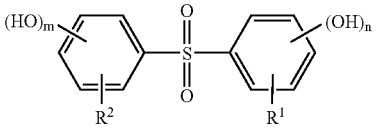

in which $R^{20}$ is 2,2,6,6-tetramethyl-4-piperidyl or 1,2,2,6,6-pentamethyl-4-piperidyl, and each of $R^{18}$ and $R^{19}$ may be the same as, or different from, each other and is 2,2,6,6-tetramethyl-4-piperidyl or 1,2,2,6,6-pentamethyl-4-piperidyl.

2. The thermal recording material of claim 1, wherein the thermal recording layer contains at least one other sensitizer selected from ethylene glycol di-m-tolyl ether, 2-benzyloxynaphthalene, bis(4-methylbenzyl)oxalate, 1,2-bis(phenoxymethyl)benzene, p-acetotoluidine or 4-(4-methylphenoxy)biphenyl.

3. The thermal recording material of claim 2, wherein the weight ratio (compound (2)/other sensitizer) of the amide derivative of the general formula (2) and other sensitizer selected from ethylene glycol di-m-tolyl ether, 2-benzyloxynaphthalene, bis(4-methylbenzyl)oxalate, 1,2-bis(phenoxymethyl)benzene, p-acetotoluidine or 4-(4-methylphenoxy)biphenyl in the thermal recording layer is in the range of 1/2 to 5/1.

4. The thermal recording material of claim 1, wherein the thermal recording layer contains a compound of the general formula (4), (4)

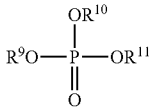

wherein each of $R^9$, $R^{10}$ and $R^{11}$ may be the same as, or different from, each other and is a hydrogen atom, an alkyl group, an alkenyl group, an aryl group, an aralkyl group, an alkali metal, an alkaline earth metal, a transition metal or an amine, and any two substituents of $R^9$, $R^{10}$ and $R^{11}$ may bond to each other and form a ring.

5. The thermal recording material of claim 1, wherein the thermal recording layer contains a compound of the general formula (5), (5)

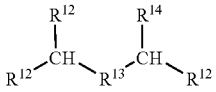

wherein $R^{12}$ is a group of the general formula (6), (6)

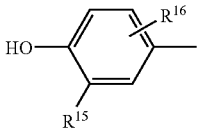

in which $R^{15}$ is cyclohexyl, phenyl or tert-butyl and $R^{16}$ is a hydrogen atom, an alkyl group having 1 to 8 carbon atoms, cyclohexyl, phenyl or tert-butyl, $R^{13}$ is a covalent bond or an alkylene group having 1 to 3 carbon atoms and $R^{14}$ is a hydrogen atom, an alkyl group having 1 to 8 carbon atoms or any group represented by $R^{12}$.

6. The thermal recording material of claim 1, wherein the thermal recording layer contains a compound of the general formula (7), (7)

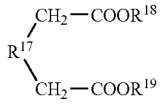

wherein $R^{17}$ is a covalent bond, an alkylene group having 1 to 8 carbon atoms or a group of the general formula (8), (8)

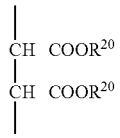

in which $R^{20}$ is 2,2,6,6-tetramethyl-4-piperidyl or 1,2,2,6,6-pentamethyl-4-piperidyl, and each of $R^{18}$ and $R^{19}$ may be the same as, or different from, each other and is 2,2,6,6-tetramethyl-4-piperidyl or 1,2,2,6,6-pentamethyl-4-piperidyl.

* * * * *